United States Patent [19]

Temple

[11] Patent Number: 4,938,516

[45] Date of Patent: Jul. 3, 1990

[54] RETRIEVING TOOL

[76] Inventor: Orza B. Temple, R.F.D. #1, Box 122, North Springfield, Vt. 05150

[21] Appl. No.: 257,697

[22] Filed: Oct. 14, 1988

[51] Int. Cl.[5] ..... A01B 1/16; B25J 1/04

[52] U.S. Cl. ..... 294/50.9; 294/19.1; 294/65.5

[58] Field of Search ..... 294/50.9, 50.8, 19.1, 294/104, 65.5, 1.4, 59

[56] References Cited

U.S. PATENT DOCUMENTS

| | | | |
|---|---|---|---|
| 1,200,196 | 10/1916 | Huberty | 294/59 X |
| 2,515,292 | 7/1950 | Carr | 294/65.5 |
| 2,525,678 | 10/1950 | Hout | 294/50.8 |
| 2,554,911 | 5/1951 | Kettle | 294/50.9 |
| 2,807,495 | 9/1957 | Pillstrom | 294/19.1 X |
| 3,225,838 | 12/1965 | Gotzinger | 294/50.8 |
| 3,799,598 | 3/1974 | Lavaggi | 294/50.8 X |
| 3,910,619 | 10/1975 | Schmieler . | |
| 4,005,892 | 2/1977 | Willaims . | |
| 4,042,269 | 8/1977 | Skermetta . | |
| 4,192,539 | 3/1980 | Broyles et al. | 294/50.9 X |
| 4,299,419 | 11/1981 | Kalan . | |
| 4,316,627 | 2/1982 | Solypa . | |
| 4,547,010 | 10/1985 | Camp | 294/50.9 |
| 4,779,913 | 10/1988 | Henry | 294/50.9 |
| 4,846,286 | 7/1989 | McNeely et al. | 294/50.9 |

*Primary Examiner*—Margaret A. Focarino
*Assistant Examiner*—Dean J. Kramer
*Attorney, Agent, or Firm*—Leon Gilden

[57] ABSTRACT

A retrieving tool is set forth wherein an elongate vertically oriented hollow post includes a control cable directed therethrough terminating proximate an upper position relative to a handle portion angularly and integrally secured to the post at an upper portion thereof with a further handle for operating the cable wherein a lower portion of the cable is secured to an upper pivoting jaw of a jaw pair. The jaw pair slidingly accepts interchangeable jaws wherein each jaw set includes a "C" spring securing the jaw set together and a lower pair of the jaw set is directed rearwardly and orthogonally relative to a receiving housing wherein the projection is slid and accepts a securement plate therethrough.

1 Claim, 4 Drawing Sheets

RETRIEVING TOOL

BACKGROUND OF THE INVENTION

1. Field of the Invention

The field of invention relates to retrieving tools, and more particularly pertains to a new and improved retrieving tool that selectively and readily enables interchangeable jaws to be utilized dependent on application desired.

2. Description of the Prior Art

The use of retrieving tools for remote pick-up of various items is well known in the prior art. Generally these items are directed to the retrieval of a single class of debris and the like and are not subject to a ready interchange of jaws.

For example, U.S. Pat. No. 3,910,619 to Schmieler wherein a pick-up scooper utilizes an illumination device proximate the handgrip portion of the tool to illuminate the scoop and closure lid that may be manipulated by the supporting hand of the user. Propelling means are provided in the receptacle and the operatable manually propellent material scooped into the entry of the receptacle. Essentially the device is ostensibly intended to be used during periods of dim light.

U.S. Pat. No. 4,005,892 to Williams sets forth a cane-like retrieving tool wherein debris is received within a fixed scoop positioned proximate a lowermost portion of the cane with the addition of a pivotal lid cooperating with the scoop.

U.S. Pat. No. 4,042,269 to Skermetta sets forth a scoop for use as a portable toilet for pets wherein a container is mounted relative to an elongate pole and wherein a pivoted flap overlies the container for selective containment of debris therein and further including a pivotal bottom of the container to assist in depositing debris accepted within the container.

U.S. Pat. No. 4,299,419 to Kalan sets forth a fireplace ash cleaning shovel wherein a lowermost scoop utilizes a pivoted closure lid manipulatable at a remote position from the lid to accept ash from a fireplace therewithin.

U.S. Pat. No. 4,316,627 to Solypa sets forth a manure collection device for use with household pets and the like wherein a bottom scoop utilizes a tined arrangement for accepting manure to be deposited within the container with a pivoted lid for secure containment of the manure deposited to enable remote disposal of the manure.

As such, it may be appreciated that there is a continuing need for a new and improved retrieval tool that utilizes easily replaceable jaw sets for adapting the tool to the retrieval of debris and the like of various configurations and in this regard, the present invention substantially fulfills this need.

SUMMARY OF THE INVENTION

In view of the foregoing disadvantages inherent in the known types of retrieval tool now present in the prior art, the present invention provides a retrieval tool which employs selective jaw sets for retrieval of various items remotely positioned relative to a user. As such, the general purpose of the present invention, which will be described subsequently in greater detail, is to provide a new and improved retrieval tool which has all the advantages of the prior art retrieval tools and none of the disadvantages.

To attain this, the present invention comprises a retrieval tool utilizing elongate hollow post formed with a handle at an outermost portion thereof and a cavity at a lowermost portion thereof wherein a cable arrangement operable in cooperation with the handle pivotally opens and closes fixed jaw sets that are replaceably mounted within the lowermost cavity. The jaw sets are secured by a securement plate directed through an elongate slot formed within an extension integrally secured to a rearwardmost face of a lowermost jaw of the jaw sets.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved retrieval tool which has all the advantages of the prior art retrieval tools and none of the disadvantages.

It is another object of the present invention to provide a new and improved retrieval tool which may be easily and efficiently manufactured and marketed.

It is a further object of the present invention to provide a new and improved retrieval tool which is of a durable and reliable construction.

An even further object of the present invention is to provide a new and improved retrieval tool which is susceptible of a low cost of manufacture with regard to both materials and labor, and which accordingly is then susceptible of low prices of sale to the consuming public, thereby making such retrieval tools economically available to the buying public.

Still yet another object of the present invention is to provide a new and improved retrieval tool which provides in the apparatuses and methods of the prior art some of the advantages thereof, while simultaneously overcoming some of the disadvantages normally associated therewith.

Still another object of the present invention is to provide a new and improved retrieval tool that efficiently and economically is arranged for selective replacement of jaw set applicable to the retrieval of various items.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
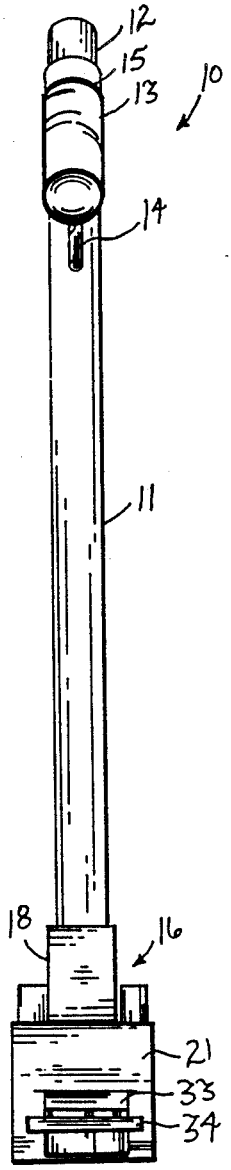
FIG. 2 is a rear orthographic view taken in elevation of the instant invention.
Figure 1:
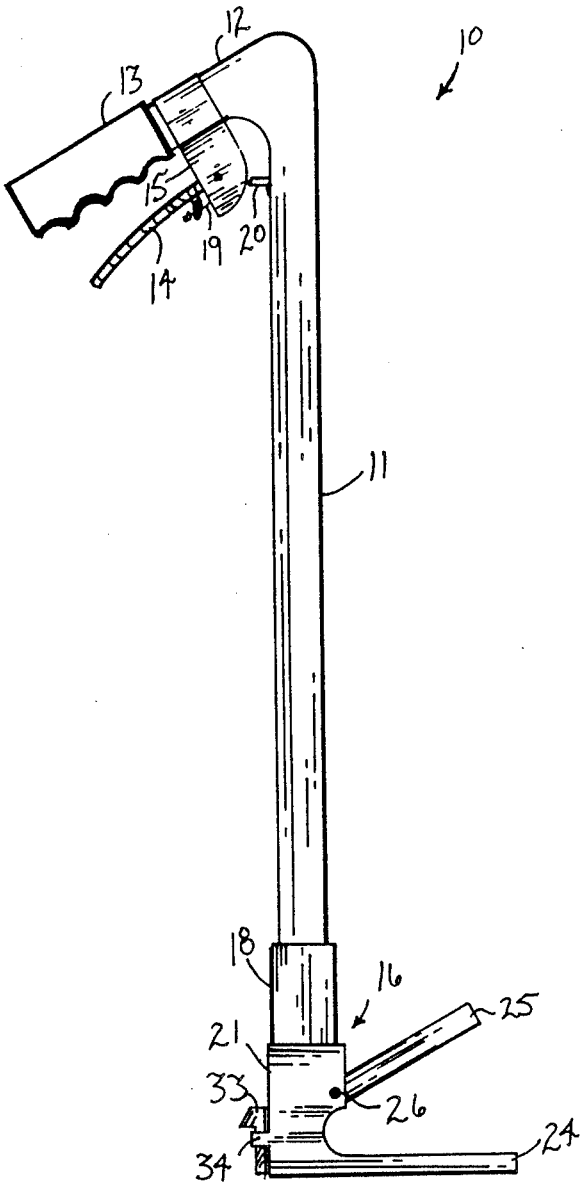
FIG. 1 is an orthographic side view taken in elevation of the instant invention.

With reference now to the drawings, and in particular to FIG. 1 thereof, a new and improved retrieval tool embodying the principles and concepts of the present invention and generally designated by the reference numeral 10 will be described.

More specifically, the retrieval tool of the instant invention essentially comprises an elongate conduit vertically disposed terminating an uppermost portion with a downwardly directed handle 12 angulated at an acute angle relative to the body 11 and terminating in a padded covering 13 for grasping by a user. Pivotally spaced from the handle 12 is an actuation handle 14 pivotally secured to a bracket 15. The actuation handle has secured thereto the forward end of a flexible cable 19 slidably mounted within a sheath 20 fixedly secured relative to the housing 11.

A lowermost terminal end of the body 11 is threadedly mounted within a threaded socket 17 formed within an upwardly directed cylindrical boss 18. The boss 18 integrally formed to an underlying housing 21.

A lowermost terminal end of the flexible cable 19 is secured to an actuation pin 22 that is directed orthogonally outwardly of an upper pivotal receiving jaw 25 pivotally mounted to the housing 21 within a cavity 23 formed within the housing 21 by means of an elongate pivot connection 26. A lower fixed receiving jaw 24 is integrally formed to the housing 21 and projects forwardly thereof to cooperate with the upper pivotal receiving jaw 25. The receiving jaws 24 and 25 are arranged to receive a jaw set 27, as illustrated in FIG. 3 for example.

The jaw set 27 includes an upper pivoted grasping jaw 28 resiliently mounted to a lower fixed grasping jaw 29 by means of a coextensive "C" spring 30 transversely aligned relative to the upper and lower grasping jaws 28 and 29 and are secure thereto by means of conventional rivets 31 or the like. The "C" spring 30 is secured within respective arcuate recesses formed in the upper and lower grasping jaws.

The lower grasping jaw 29 is formed with a rearwardly directed extension 32 extending rearwardly of the grasping jaw 29 and of a length to exceeded the length of the lower fixed jaw 24 and associate housing 21 such that the extension 32 is directed rearwardly through a complementary opening 33*a*. The extension 32 is formed with an elongate slot 33*b* for accepting an "L" shaped securement plate 33 therethrough. The securement plate 33 is normally positioned within a housing bracket 34 and integrally formed to a rear face of the housing 21 whereupon lifting of the securement plate 33 relative to the bracket 34, the lower grasping jaw 29 may be slit rearwardly and upon directing the securement plate again downwardly, it will engage the jaw extension 32 through the associated slot 33*b*.

Figure 3:
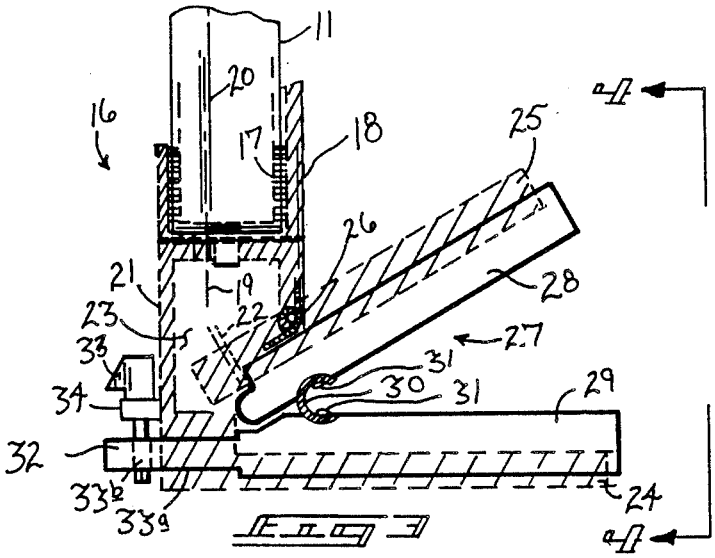
FIG. 3 is an orthographic side view taken in elevation of a jaw set positioned within the retrieval tool.
Figure 4:
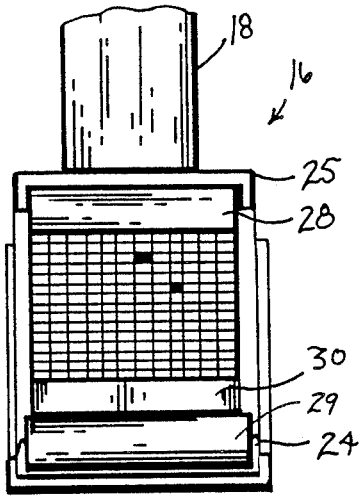
FIG. 4 is an orthographic view taken in elevation along the lines 4—4 of FIG. 3.

Since the jaw set 27 comprising the upper and lower grasping jaws 28 and 29 are secured together by means of the elongate "C" spring 30, the jaw set 27 will remain in operative position, as illustrated in FIG. 3, and upon grasping of the actuation handle 14, the lower terminal end of the flexible cable 19 will draw the associated actuation pin 22 upwardly and thereby close the jaw set 27 of the tool 20.

Figure 5A:
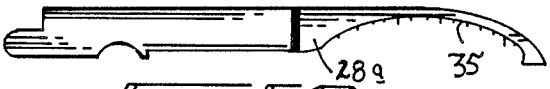
FIG. 5*a* is an orthographic side view of a top jaw of a first jaw set.
Figure 5B:
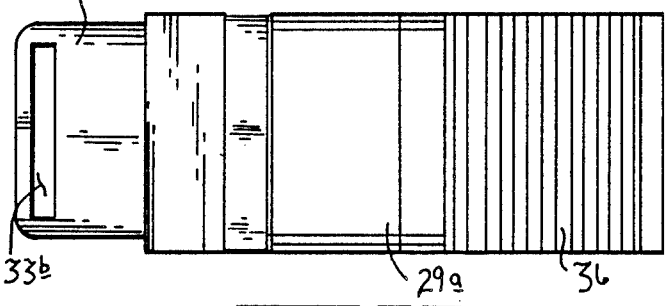
FIG. 5*b* is a plan view of a lower jaw of a first jaw set.
Figure 5C:
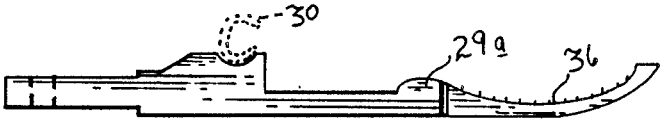
FIG. 5*c* is an orthographic side view taken in elevation of a bottom jaw of a first jaw set.
Figure 6A:
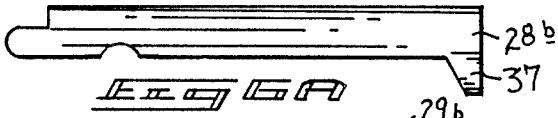
FIG. 6*a* is a side orthographic view taken in elevation of a top jaw of a second jaw set.
Figure 6B:
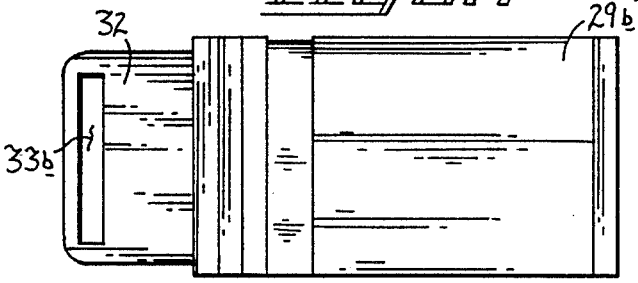
FIG. 6*b* is a plan view of a lower jaw of a second jaw set.
Figure 6C:
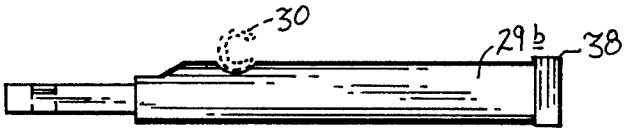
FIG. 6*c* is an orthographic side view taken in elevation of the lower jaw of a second jaw set.
Figure 7A:
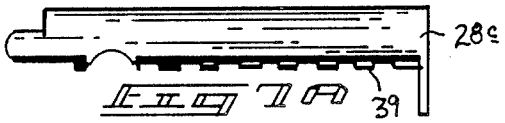
FIG. 7*a* is a side orthographic view taken in elevation of a top jaw of a third jaw set.
Figure 7B:
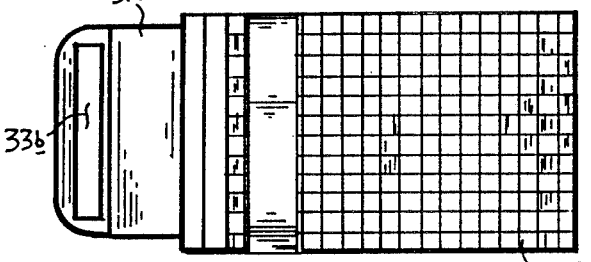
FIG. 7*b* is a plan view of a lower jaw of a third jaw set.
Figure 7C:
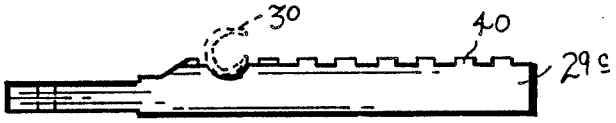
FIG. 7*c* is an orthographic side view taken in elevation of a lower jaw of a third jaw set.

The FIGS. 5*a* and 5*b* set forth a first example of a series of jaw sets that may be utilized by the instant invention. The upper grasping jaw 28*a* is formed with an serrated arcuate recess complementarily coacting with lower serrated arcuate recess 36*a* for the grasping of aluminum cans and the like. The jaw set represented in FIGS. 6*a*, 6*b*, and 6*c* utilize a downwardly directed plate 37 integrally formed to the upper grasping jaw 28*b* cooperating with an enlarged projection 38 orthogonally formed to the lower grasping jaw 29*b* wherein the downwardly directed plate overlaps the enlarged projection 38 upon closure of the grasping jaws 28*b* and 29*b* for securement of flexible debris, such as paper, therebetween.

Figure 8A:
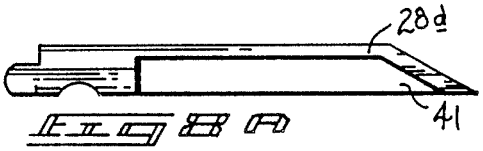
FIG. 8*a* is an orthographic side view taken in elevation of a top jaw of a fourth jaw set.
Figure 8B:
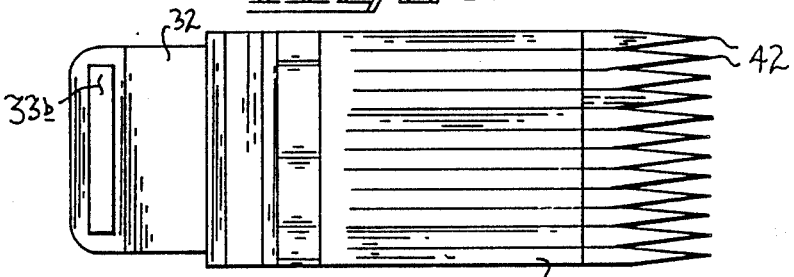
FIG. 8*b* is a plan view of a lower jaw of a fourth jaw set.
Figure 8C:
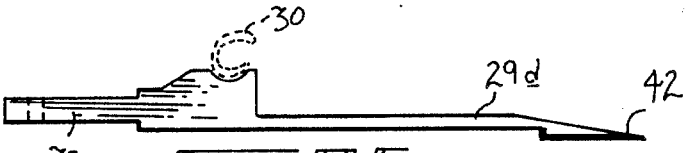
FIG. 8*c* is an orthographic side view taken in elevation of a lower jaw of a fourth jaw set.

The third jaw set illustrating jaws 28*c* and 29*c* employ a series of cooperating upper and lower magnets 40 and 41 for the collection of metallic debris, such as nails, wire and the like. The fourth jaw set illustrated in FIGS. 8*a*, 8*b*, and 8*c* utilize a lower fixed grasping jaw 29*d* formed with a series of projecting tines with an overlapping upper pivotal grasping jaw 28*c* formed with a cavity 41 to secure weeds and the like therebetween.

As to the manner of usage and operation of the instant invention, the same should be apparent from the above description and accordingly no further discussion relative to the manner of usage and operation of the instant invention shall be set forth.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A retrieval tool for remote grasping of debris comprising, an elongate body terminating at an upper end with a handle formed at an acute angle relative to said body, and an actuation handle spaced below and pivotally mounted to said handle, and a housing integrally secured and aligned with said handle formed with a cavity therein, and a lower fixed receiving jaw projecting orthogonally and outwardly of said housing and cavity underlying a pivoted receiving jaw overlying said cavity, and said pivoted jaw pivotally mounted to said housing, and a jaw set including a lower grasping jaw and an upper grasping jaw receivable within said cavity wherein said lower grasping jaw is receivable within said lower fixed receiving jaw and said upper grasping jaw is receivable within said upper pivotal jaw, and wherein said lower grasping jaw includes a rearwardly directed extension formed with a slot therein directed through an opening rearwardly of said cavity and outwardly of said housing, and wherein a securement plate mounted within a bracket rearwardly of said housing is selectively positionable within said slot formed within said extension directed outwardly of said housing, and wherein said upper grasping jaw and said lower grasping jaw are pivotally mounted and secured together by an elongate "C" spring wherein said "C" spring is receivable within arcuate recesses formed in said upper and lower grasping jaws, and wherein a flexible cable is secured to said actuation handle at one end and to said upepr pivotal receiving jaw at its other end for pivotment of said receiving jaws and said jaw set upon manipulation of said actuation handle, and wherein said jaw set comprises an upper grasping jaw formed with a serrated arcuate recess cooperating with a further serrated arcuate recess formed in said lower grasping jaw, and wherein said upper grasping jaw includes a downwardly projecting plate cooperating with an enlarged projection orthogonally formed to a forward terminal end of said lower grasping jaw wherein said plate is mounted for overlapping cooperation with said projection for retrieval of flexible debris therebetween, and wherein said jaw set includes an upper grasping jaw including a magnet cooperating with a lower grasping jaw including a further magnet for retrieval of metallic debris within said jaw set, and wherein said jaw set includes an upper grasping jaw including a cavity cooperating with a lower grasping jaw wherein said lower grasping jaw includes a plurality of forwardly directed tines for securement of garden weeds and the like therebetween.

* * * * *